US010190194B2

(12) United States Patent
Maki et al.

(10) Patent No.: US 10,190,194 B2
(45) Date of Patent: Jan. 29, 2019

(54) COPPER ALLOY FOR ELECTRONIC AND ELECTRICAL EQUIPMENT, COPPER ALLOY THIN SHEET FOR ELECTRONIC AND ELECTRICAL EQUIPMENT, AND CONDUCTIVE COMPONENT FOR ELECTRONIC AND ELECTRICAL EQUIPMENT, TERMINAL

(71) Applicants: MITSUBISHI MATERIALS CORPORATION, Tokyo (JP); Mitsubishi Shindoh Co., Ltd., Tokyo (JP)

(72) Inventors: Kazunari Maki, Saitama (JP); Hiroyuki Mori, Tsukuba (JP); Daiki Yamashita, Osaka (JP)

(73) Assignees: MITSUBISHI MATERIALS CORPORATION, Tokyo (JP); MITSUBISHI SHINDOH CO., LTD., Tokyo (JP)

( * ) Notice: Subject to any disclaimer, the term of this patent is extended or adjusted under 35 U.S.C. 154(b) by 259 days.

(21) Appl. No.: 14/898,950

(22) PCT Filed: Feb. 20, 2014

(86) PCT No.: PCT/JP2014/054042
§ 371 (c)(1),
(2) Date: Dec. 16, 2015

(87) PCT Pub. No.: WO2015/004939
PCT Pub. Date: Jan. 15, 2015

(65) Prior Publication Data

US 2016/0369374 A1 Dec. 22, 2016

(30) Foreign Application Priority Data

Jul. 10, 2013 (JP) ..... 2013-145007
Dec. 27, 2013 (JP) ..... 2013-273548

(51) Int. Cl.

| | |
|---|---|
| ***C22C 9/04*** | (2006.01) |
| ***H01B 1/02*** | (2006.01) |
| ***B22D 7/00*** | (2006.01) |
| ***C23C 30/00*** | (2006.01) |
| ***C22F 1/08*** | (2006.01) |
| ***C22F 1/02*** | (2006.01) |

(Continued)

(52) U.S. Cl.

CPC ..... *C22C 9/04* (2013.01); *B22D 7/005* (2013.01); *C22C 1/02* (2013.01); *C22F 1/00* (2013.01); *C22F 1/08* (2013.01); *C23C 28/02* (2013.01); *C23C 28/021* (2013.01); *C23C 28/023* (2013.01); *C23C 30/00* (2013.01); *C23C 30/005* (2013.01); *H01B 1/026* (2013.01); *Y10T 428/1291* (2015.01); *Y10T 428/12431* (2015.01); *Y10T 428/12438* (2015.01); *Y10T 428/12708* (2015.01); *Y10T 428/12715* (2015.01); *Y10T 428/12882* (2015.01); *Y10T 428/12903* (2015.01); *Y10T 428/263* (2015.01); *Y10T 428/264* (2015.01); *Y10T 428/265* (2015.01)

(58) Field of Classification Search

CPC .. B22D 7/005; C22C 1/02; C22C 9/04; C22C 9/00; C23C 30/005; C23C 30/00; C23C 28/021; C23C 28/023; C23C 28/02; H01B 1/026; C22F 1/00; C22F 1/08; B32B 15/01; B32B 15/043; B32B 15/04; Y10T 428/12431; Y10T 428/12438; Y10T 428/12708; Y10T 428/12715; Y10T 428/12882; Y10T 428/1291; Y10T 428/12903; Y10T 428/263; Y10T 428/264; Y10T 428/265

See application file for complete search history.

(56) References Cited

U.S. PATENT DOCUMENTS

| | | | | |
|---|---|---|---|---|
| 6,471,792 | B1 | 10/2002 | Breedis et al. | |
| 2014/0227129 | A1* | 8/2014 | Oishi | B21B 1/22 420/472 |
| 2014/0255248 | A1* | 9/2014 | Oishi | H01B 1/026 420/472 |

FOREIGN PATENT DOCUMENTS

| | | | |
|---|---|---|---|
| CN | 101522926 | A | 9/2009 |
| CN | 101693960 | A | 4/2010 |

(Continued)

OTHER PUBLICATIONS

Nielsen, Jr., "Metallurgy of Copper-Base Alloy," in Copper Development Association, downloaded from https://www.copper.org/resources/properties/703_5/, on Sep. 13, 2017, Feb. 2017.*

(Continued)

*Primary Examiner* — Michael E. La Villa

(74) *Attorney, Agent, or Firm* — Leason Ellis LLP

(57) ABSTRACT

One aspect of this copper alloy for an electronic and electrical equipment contains: more than 2.0 mass % to 36.5 mass % of Zn; 0.10 mass % to 0.90 mass % of Sn; 0.15 mass % to less than 1.00 mass % of Ni; and 0.005 mass % to 0.100 mass % of P, with the balance containing Cu and inevitable impurities, wherein atomic ratios of amounts of elements satisfy 3.00<Ni/P<100.00 and 0.10<Sn/Ni<2.90, and a strength ratio $TS_{TD}/TS_{LD}$ of tensile strength $TS_{TD}$ in a direction perpendicular to a rolling direction to tensile strength $TS_{LD}$ in a direction parallel to the rolling direction exceeds 1.09.

12 Claims, 1 Drawing Sheet

(51) Int. Cl.

| | |
|---|---|
| ***C23C 28/02*** | (2006.01) |
| ***C22F 1/00*** | (2006.01) |
| ***C22C 1/02*** | (2006.01) |

(56) References Cited

FOREIGN PATENT DOCUMENTS

| | | | |
|---|---|---|---|
| JP | 05-033087 | A | 2/1993 |
| JP | 2005-060773 | A | 3/2005 |
| JP | 3717321 | B | 11/2005 |
| JP | 2006-283060 | A | 10/2006 |
| JP | 3953357 | B | 8/2007 |
| JP | 2009-013499 | A | 1/2009 |
| JP | 5153949 | B | 2/2013 |
| JP | 2013-213236 | A | 10/2013 |
| JP | 5303678 | B | 10/2013 |
| JP | 5417523 | B | 2/2014 |
| JP | 5417539 | B | 2/2014 |
| TW | 201319278 | A | 5/2013 |
| WO | WO-2012/096237 | A | 7/2012 |
| WO | WO-2013/039201 | A | 3/2013 |
| WO | WO-2013/039207 | A | 3/2013 |

OTHER PUBLICATIONS

Office Action dated Sep. 2, 2016 for the corresponding Chinese Patent Application No. 201480032727.6.

Extended European Search Report dated Mar. 20, 2017 for the corresponding European Patent Application No. 14823795.1.

Kronberg et al, "Secondary Recrystallization in Copper", *Metals Transactions*, Aug. 1949, pp. 501-514, vol. 185.

Brandon, "The Structure of High-Angle Grain Boundaries", *ACTA Metallurgica*, Nov. 1966, pp. 1479-1484, vol. 14.

International Search Report dated Apr. 15, 2014 for the corresponding PCT Application No. PCT/JP2014/054042.

Office Action dated May 21, 2015 for the corresponding Taiwanese Application No. 103105645.

* cited by examiner

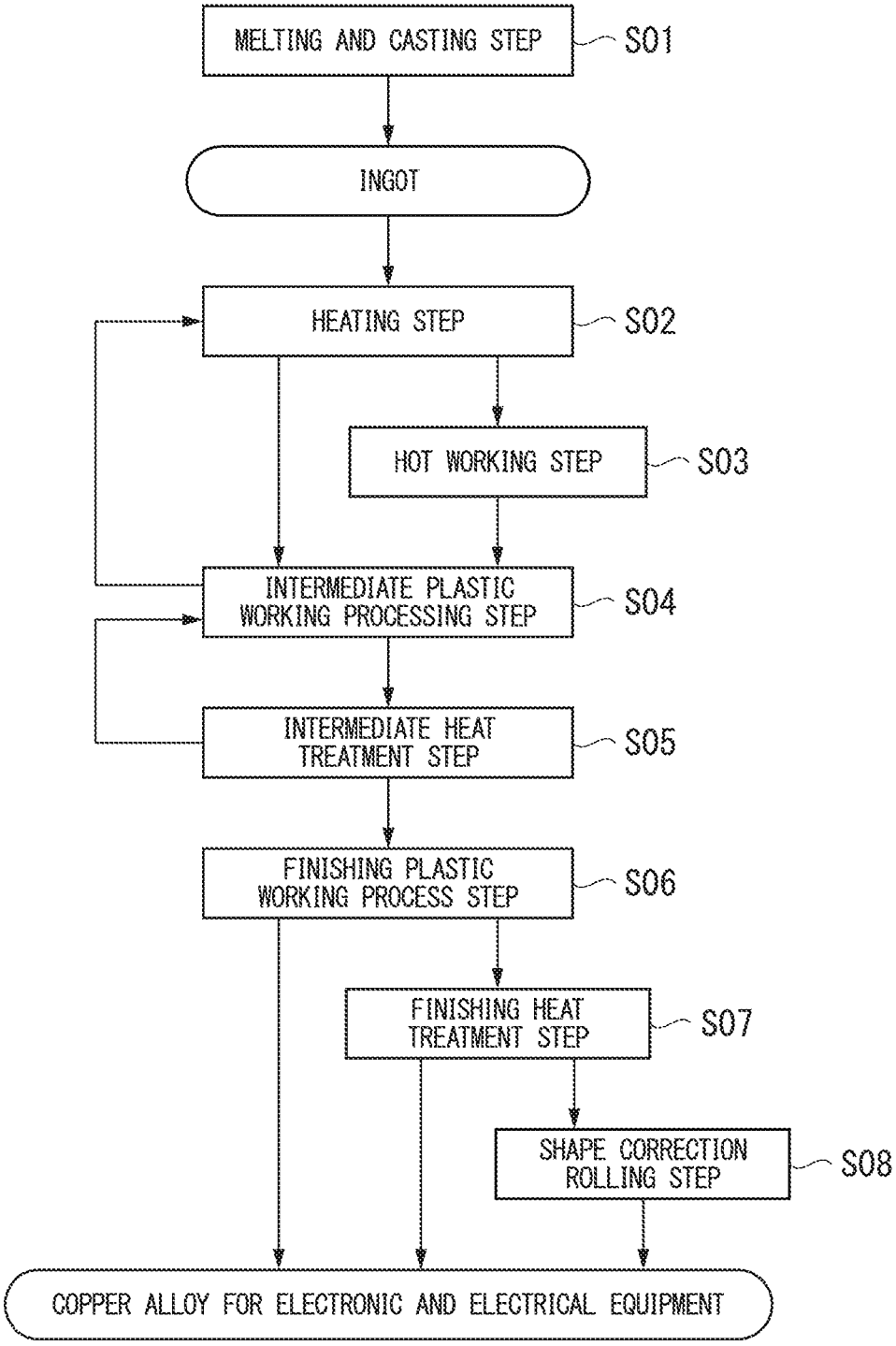
MELTING AND CASTING STEP
S01
INGOT
HEATING STEP
S02
HOT WORKING STEP
S03
INTERMEDIATE PLASTIC WORKING PROCESSING STEP
S04
INTERMEDIATE HEAT TREATMENT STEP
S05
FINISHING PLASTIC WORKING PROCESS STEP
S06
FINISHING HEAT TREATMENT STEP
S07
SHAPE CORRECTION ROLLING STEP
S08
COPPER ALLOY FOR ELECTRONIC AND ELECTRICAL EQUIPMENT

COPPER ALLOY FOR ELECTRONIC AND ELECTRICAL EQUIPMENT, COPPER ALLOY THIN SHEET FOR ELECTRONIC AND ELECTRICAL EQUIPMENT, AND CONDUCTIVE COMPONENT FOR ELECTRONIC AND ELECTRICAL EQUIPMENT, TERMINAL

CROSS-REFERENCE TO RELATED PATENT APPLICATIONS

This application is a U.S. National Phase application under 35 U.S.C. § 371 of International Patent Application No. PCT/JP2014/054042, filed Feb. 20, 2014, and claims the benefit of Japanese Patent Applications No. 2013-145007, filed Jul. 10, 2013 and No. 2013-273548, filed Dec. 27, 2013, all of which are incorporated herein by reference in their entireties. The International application was published in Japanese on Jan. 15, 2015 as International Publication No. WO/2015/004939 under PCT Article 21(2).

FIELD OF THE INVENTION

The present invention relates to a Cu—Zn—Sn based copper alloy for electronic and electrical equipment used as a conductive component (conductive part) for electronic and electrical equipment such as a connector of a semiconductor device or other terminals, movable conductive piece of an electromagnetic relay, a lead frame, or the like, a copper alloy thin sheet for electronic and electrical equipment using the copper alloy, a conductive part for an electronic and electrical equipment, and a terminal.

BACKGROUND OF THE INVENTION

As the conductive part for electronic and electrical equipment described above, a Cu—Zn based alloy has been widely used in the related art, from a viewpoint of a balance between strength, workability (formability), and cost.

In a case of a terminal such as a connector, a material is used which is obtained by performing tin (Sn) plating on a surface of a base material (sheet) consisting of a Cu—Zn alloy, in order to improve reliability regarding contact with a conductive member of a partner side of the terminal. In a conductive part such as a connector which is obtained by performing Sn plating on a surface of a Cu—Zn alloy as a base material, a Cu—Zn—Sn based alloy may be used, in order to improve recycling efficiency of the Sn plated material and to improve strength.

Herein, for example, a conductive part for electronic and electrical equipment such as a connector is generally manufactured by a method which includes: obtaining a predetermined shape by performing punching on a thin sheet (rolled sheet) having a thickness of approximately 0.05 mm to 1.0 mm; and performing bending at least a part thereof. In this case, the connector is used such that the connector comes in contact with a conductive member of a partner side through the vicinity of the bended portion to acquire electric connection with the conductive member of the partner side and the contact state is maintained with the conductive material of the partner side by utilizing spring properties of the bended portion.

For a copper alloy for electronic and electrical equipment used in such a conductive part for an electronic and electrical equipment, excellent electrical conductivity, rollability, or punching formability is desired. In addition, as described above, in a case of the connector which is subjected to a bending process and is used to maintain the contact state with a conductive material of a partner side through the vicinity of the bended portion by utilizing spring properties of the bended portion, it is required that bending formability and stress relaxation resistance are excellent.

Therefore, Patent Documents 1 to 4 propose a method for improving stress relaxation resistance of the Cu—Zn—Sn based alloy.

Patent Document 1 discloses that it is possible to improve stress relaxation resistance by including Ni in a Cu—Zn—Sn based alloy and generating a Ni—P based compound, and addition of Fe is also effective in the improvement of stress relaxation resistance.

Patent Document 2 discloses that it is possible to improve strength, elasticity, and heat resistance by adding Ni and Fe with P to a Cu—Zn—Sn based alloy and generating a compound, and it is considered that the improvement of strength, elasticity, and heat resistance means improvement of stress relaxation resistance.

Patent Document 3 discloses that it is possible to improve stress relaxation resistance by adding Ni to a Cu—Zn—Sn based alloy and adjusting a ratio Ni/Sn to be in a specific range, and addition of small amount of Fe is also effective in the improvement of stress relaxation resistance.

Patent Document 4 aimed at (designed for) a lead frame discloses that it is possible to improve stress relaxation resistance by adding Ni and Fe with P to a Cu—Zn—Sn based alloy, adjusting an atomic ratio (Fe+Ni)/P to be in a range of 0.2 to 3, and generating a Fe—P based compound, a Ni—P based compound, and a Fe—Ni—P based compound.

However, recently, smaller and lightweight electronic and electrical equipment is required, and therefore, it is required that strength, bending formability, and stress relaxation resistance are further improved, in the copper alloy for electronic and electrical equipment used in the conductive part for an electronic and electrical equipment.

However, in Patent Documents 1 and 2, the amounts of Ni, Fe, and P were merely considered and it was difficult to reliably and sufficiently improve stress relaxation resistance by only adjusting the amounts thereof.

In addition, Patent Document 3 discloses the adjustment of the ratio Ni/Sn, but there was no consideration of a relationship between a P compound and stress relaxation resistance and it was difficult to sufficiently and reliably improve stress relaxation resistance.

Further, in Patent Document 4, the total amount of Fe, Ni, and P and the atomic ratio (Fe+Ni)/P were merely adjusted, and it was difficult to sufficiently improve the stress relaxation resistance.

As described above, it was difficult to sufficiently improve stress relaxation resistance of the Cu—Zn Sn based alloy by the method proposed in the related art. Accordingly, in the connector having the structure described above, residual stress is alleviated over time or in a high temperature environment; and thereby, a contact pressure against a conductive member of a partner side is not maintained, and a problem such as contact failure may occur early. In order to avoid such a problem, there was no choice in the related art but to increase a thickness of a material, and this caused an increase in the cost of a material and an increase in weight. Therefore, further reliable and sufficient improvement of stress relaxation resistance is strongly desired.

In addition, along additional miniaturization and light weighting of an electronic and electrical equipment, from a viewpoint of a yield of a material in a small terminal, a small terminal is formed by performing the bending so that an axis of bending is in a direction perpendicular to a rolling direction (Good Way: GW) and deformation is slightly applied to a direction of the axis of bending parallel to the rolling direction (Bad way: BW), and spring properties are ensured by a material strength $TS_{TD}$ which is measured by performing tensile test in the BW direction. Accordingly, excellent bending formability in the GW direction and high strength in the BW direction are acquired.

PRIOR ART DOCUMENTS

Patent Documents

Patent Document 1: Japanese Unexamined Patent Application, First Publication No. H05-33087

Patent Document 2: Japanese Unexamined Patent Application, First Publication No. 2006-283060

Patent Document 3: Japanese Patent No. 3953357

Patent Document 4: Japanese Patent No. 3717321

Problems to be Solved by the Invention

The invention is made in view of such circumstances, and an object of the invention is to provide a copper alloy for electronic and electrical equipment having reliably and sufficiently excellent stress relaxation resistance and excellent strength and bending formability, a copper alloy thin sheet for electronic and electrical equipment using the copper alloy, a conductive part for electronic and electrical equipment, and a terminal.

SUMMARY OF THE INVENTION

Means for Solving the Problem

The inventors have performed experiments and research and found that stress relaxation resistance is reliably and sufficiently improved and a copper alloy having excellent strength in a BW direction and excellent bending formability in a GW direction is obtained, by satisfying the following conditions (a) and (b), and the invention was completed.

(a) An appropriate amount of Ni is added to a Cu—Zn—Sn based alloy, an appropriate amount of P is added thereto, and the atomic ratio Ni/P of the amount of Ni to the amount of P and an atomic ratio Sn/Ni of the amount of Sn to the amount of Ni are adjusted to suitable ranges.

(b) At the same time, a strength ratio $TS_{TD}/TS_{LD}$ which is calculated from strength $TS_{TD}$ obtained when tensile test is performed in a direction perpendicular to the rolling direction and strength $TS_{LD}$ obtained when tensile test is performed in a direction parallel to the rolling direction, exceeds a predetermined value.

In addition, the inventors found that it is possible to further improve stress relaxation resistance and strength by adding appropriate amounts of Fe and Co with the above-described Ni and P.

A copper alloy for electronic and electrical equipment according to the invention, includes: more than 2.0 mass % to 36.5 mass % of Zn, 0.10 mass % to 0.90 mass % of Sn, 0.15 mass % to less than 1.00 mass % of Ni, and 0.005 mass % to 0.100 mass % of P, with the balance containing Cu and inevitable impurities, wherein an atomic ratio Ni/P of an amount of Ni to an amount of P satisfies a relationship of $3.00<Ni/P<100.00$, an atomic ratio Sn/Ni of an amount of Sn to an amount of Ni satisfies a relationship of $0.10<Sn/Ni<2.90$, and a strength ratio $TS_{TD}/TS_{LD}$ which is calculated from strength $TS_{TD}$ obtained when tensile test is performed in a direction perpendicular to a rolling direction and strength $TS_{LD}$ obtained when tensile test is performed in a direction parallel to the rolling direction exceeds 1.09.

According to the copper alloy for electronic and electrical equipment having the configuration described above, the strength ratio $TS_{TD}/TS_{LD}$ which is calculated from strength $TS_{TD}$ obtained when tensile test is performed in a direction perpendicular to the rolling direction and strength $TS_{LD}$ obtained when tensile test is performed in a direction parallel to the rolling direction exceeds 1.09. Accordingly, a large number of {220} plane exists on a surface vertical to a normal direction with respect to a rolled surface; and thereby, excellent bending formability is obtained when performing bending so that an axis of bending is in a direction perpendicular to a rolling direction, and the strength $TS_{TD}$ obtained when the tensile test is performed in a direction perpendicular to the rolling direction is increased.

In addition, by adding Ni with P and controlling the addition ratio between Sn, Ni, and P, a Ni—P based precipitate containing Ni and P which is precipitated from a matrix phase (mainly α phase) is suitably present. Therefore, the stress relaxation resistance is reliably and sufficiently excellent and the strength (proof stress) is high. Herein, the Ni—P based precipitate is a Ni—P binary precipitate, and examples thereof may include a multi-component precipitate which further contains other elements, for example, main components of Cu, Zn, and Sn, and impurities of O, S, C, Fe, Co, Cr, Mo, Mn, Mg, Zr, Ti, and the like. In addition, the Ni—P based precipitate is present in a state of a phosphide or an alloy in which phosphorus is solid-dissolved.

A copper alloy for electronic and electrical equipment according to a second aspect of the invention includes: more than 2.0 mass % to 36.5 mass % of Zn, 0.10 mass % to 0.90 mass % of Sn, 0.15 mass % to less than 1.00 mass % of Ni, 0.005 mass % to 0.100 mass % of P, and either one or both of 0.001 mass % to less than 0.100 mass % of Fe and 0.001 mass % to less than 0.100 mass % of Co, with the balance containing Cu and inevitable impurities, wherein an atomic ratio (Ni+Fe+Co)/P of a total amount (Ni+Fe+Co) of Ni, Fe, and Co to an amount of P satisfies a relationship of $3.00<(Ni+Fe+Co)/P<100.00$, an atomic ratio Sn/(Ni+Fe+Co) of an amount of Sn to a total amount (Ni+Fe+Co) of Ni, Fe, and Co satisfies a relationship of $0.10<Sn/(Ni+Fe+Co)<2.90$, an atomic ratio (Fe+Co)/Ni of a total amount of Fe and Co to an amount of Ni satisfies a relationship of $0.002\leq(Fe+Co)/Ni<1.500$, and a strength ratio $TS_{TD}/TS_{LD}$ which is calculated from strength $TS_{TD}$ obtained when tensile test is performed in a direction perpendicular to a rolling direction and strength $TS_{LD}$ obtained when tensile test is performed in a direction parallel to the rolling direction exceeds 1.09.

According to the copper alloy for electronic and electrical equipment of the second aspect of the invention, Ni is added with P Fe and Co are further added, and the addition ratio between Sn, Ni, Fe, Co, and P is suitably controlled. Thereby, since a [Ni, (Fe, Co)]—P based precipitate containing Ni, P, and either one or both of Fe and Co which is precipitated from a matrix phase (mainly α phase) is suitably present, the stress relaxation resistance is reliably and sufficiently excellent and the strength (proof stress) is high. Herein, the [Ni, (Fe, Co)]—P based precipitate is a binary precipitate of Ni—P, Fe—P, or Co—P, a ternary precipitate of Ni—Fe—P, Ni—Co—P, or Fe—Co—P, or a quaternary precipitate of Ni—Fe—Co—P, and examples of the [Ni, (Fe, Co)]—P based precipitate may include a multi-component precipitate further containing other elements, for example, main components of Cu, Zn, and Sn, and impurities of O, S, C, (Fe), (Co), Cr, Mo, Mn, Mg, Zr, Ti, and the like. In addition, the [Ni, (Fe, Co)]—P based precipitate is present in a state of a phosphide or an alloy in which phosphorus is solid-dissolved.

A copper alloy for electronic and electrical equipment according to a third aspect of the invention is the above-described copper alloy for an electronic and electrical equipment, wherein the strength $TS_{TD}$ obtained when tensile test is performed in a direction perpendicular to the rolling direction is 500 MPa or more, and when a direction perpendicular to the rolling direction is set as an axis of bending, bending formability represented as a ratio R/t when a radius of a W bending tool is set as R and a thickness of the copper alloy is set as t is 1 or less.

According to the copper alloy for electronic and electrical equipment of the third aspect of the invention, since the strength $TS_{TD}$ obtained when the tensile test is performed in a direction perpendicular to the rolling direction is 500 MPa or more, the strength is sufficiently high. When a direction perpendicular to the rolling direction is set as an axis of bending, bending formability represented as a ratio R/t when a radius of W bending tool is set as R and a thickness of a copper alloy is set as t is 1 or less; and accordingly, bending formability in a GW direction can be sufficiently ensured. Therefore, the copper alloy for electronic and electrical equipment of the third aspect is suitable for a conductive part in which particularly high strength is required, such as a movable conductive piece of a electromagnetic relay or a spring portion of a terminal.

A copper alloy for electronic and electrical equipment according to a fourth aspect of the invention is the above-described copper alloy for an electronic and electrical equipment, wherein an average grain size of crystal grains of an α phase containing Cu, Zn, and Sn is in a range of 0.1 μm to 15 μm, and a precipitate containing at least one element selected from a group consisting of Fe, Co, and Ni, and P is contained.

According to the copper alloy for electronic and electrical equipment of the fourth aspect of the invention, since the average grain size of crystal grains of an α phase containing Cu, Zn, and Sn is in a range of 0.1 μm to 15 μm, it is possible to further improve the strength (proof stress). In addition, since a precipitate containing at least one element selected from a group consisting of Fe, Co, and Ni, and P is contained, it is possible to sufficiently ensure stress relaxation resistance.

A copper alloy for electronic and electrical equipment according to a fifth aspect of the invention is the above-described copper alloy for an electronic and electrical equipment, wherein a special grain boundary length ratio (Lσ/L) measured by the following method is 10% or more, and measurement regarding an α phase containing Cu, Zn, and Sn is performed on a measurement surface area of 1000 $\mu m^2$ or more at every measurement intervals of 0.1 μm by an EBSD method, measured results are analyzed by data analysis software OIM to obtain a CI value in each measurement point, a measurement point in which a CI value is 0.1 or less is removed, a boundary having more than 15° of an angle difference between neighboring measuring points is assigned as a grain boundary, and a ratio of a sum Lσ of respective grain boundary lengths of Σ3, Σ9, Σ27a, and Σ27b to a total L of all the grain boundary lengths is obtained as the special grain boundary length ratio (Lσ/L).

According to the copper alloy for electronic and electrical equipment of the fifth aspect of the invention, since the special grain boundary length ratio (Lσ/L) is set to be 10% or more, the ratio of the boundary having high crystallinity (boundary where a degree of disarrangement of atomic arrangement is small) is increased. Accordingly, it is possible to decrease a proportion of a boundary which becomes a starting point of breakage at the time of bending and excellent bending formability is obtained.

The EBSD method means an electron backscatter diffraction patterns (EBSD) method by a scanning electron microscope attached with a backscattered electron diffraction image system. OIM is data analysis software (Orientation Imaging Microscopy: OIM) for analyzing crystal orientation using measurement data by EBSD. The CI value is a confidence index and is a numerical value displayed as a numerical value indicating reliability of crystal orientation determination, when performing analysis using analysis software OIM Analysis (Ver. 5.3) of the EBSD apparatus (for example, "EBSD: using OIM (third edition)" written by Seiichi Suzuki, 2009, 9, TSL solution publication).

A copper alloy thin sheet for electronic and electrical equipment according to one aspect of the invention includes a rolled material of the above-described copper alloy for an electronic and electrical equipment, wherein a thickness is in a range of 0.05 mm to 1.0 mm.

The copper alloy thin sheet for electronic and electrical equipment having the configuration described above can be suitably used in a connector or other terminals, a movable conductive piece of an electromagnetic relay, a lead frame, or the like.

Herein, in the copper alloy thin sheet for electronic and electrical equipment of the invention, Sn plating may be performed on surfaces.

In this case, since a base material which is a base of Sn plating is configured with the Cu—Zn—Sn based alloy containing 0.10 mass % to 0.90 mass % of Sn, a component such as a used connector is collected as a scrap of a Sn-plated Cu—Zn based alloy and excellent recycling efficiency can be ensured.

A conductive part for electronic and electrical equipment according to one aspect of the invention includes the above-described copper alloy for an electronic and electrical equipment.

A terminal according to one aspect of the invention includes the above-described copper alloy for an electronic and electrical equipment.

A conductive part for electronic and electrical equipment according to another aspect of the invention includes the above-described copper alloy thin sheet for an electronic and electrical equipment.

A terminal according to another aspect of the invention includes the above-described copper alloy thin sheet for electronic and electrical equipment.

According to the conductive parts for electronic and electrical equipment and the terminals having the configurations described above, since stress relaxation resistance is particularly excellent, residual stress is rarely alleviated over time or in a high temperature environment, and the reliability is excellent. In addition, it is possible to reduce the thickness of the conductive part for electronic and electrical equipment and the terminal.

Effects of the Invention

According to the invention, it is possible to provide a copper alloy for electronic and electrical equipment having reliably and sufficiently excellent stress relaxation resistance and excellent strength and bending formability, a copper alloy thin sheet for electronic and electrical equipment using the copper alloy, a conductive part for an electronic and electrical equipment, and a terminal.

BRIEF DESCRIPTION OF THE DRAWINGS

FIG. 1 is a flowchart showing an example of steps of a manufacturing method of a copper alloy for electronic and electrical equipment of the invention.

DETAILED DESCRIPTION OF THE INVENTION

Hereinafter, a copper alloy for electronic and electrical equipment which is one embodiment of the invention will be described.

A copper alloy for electronic and electrical equipment of the embodiment contains more than 2.0 mass % to 36.5 mass % of Zn, 0.10 mass % to 0.90 mass % of Sn, 0.15 mass % to less than 1.00 mass % of Ni, and 0.005 mass % to 0.100 mass % of P, with the balance containing Cu and inevitable impurities.

As an amount ratio between each alloy element, the atomic ratio Ni/P of the amount of Ni to the amount of P satisfies the following Expression (1).

$$3.00<Ni/P<100.00 \quad (1)$$

In addition, the atomic ratio Sn/Ni of the amount of Sn to the amount of Ni is determined so as to satisfy the following Expression (2).

$$0.10<Sn/Ni<2.90 \quad (2)$$

The copper alloy for an electronic and electrical equipment of the embodiment may further contain either one or both of 0.001 mass % to less than 0.100 mass % of Fe and 0.001 mass % to less than 0.100 mass % of Co.

As an amount ratio between each alloy element, the atomic ratio (Ni+Fe+Co)/P of the total amount (Ni+Fe+Co) of Ni, Fe, and Co to the amount of P satisfies the following Expression (1').

$$3.00<(Ni+Fe+Co)/P<100.00 \quad (1')$$

In addition, the atomic ratio Sn/(Ni+Fe+Co) of the amount of Sn to the total amount (Ni+Fe+Co) of Ni, Fe, and Co satisfies the following Expression (2').

$$0.10<Sn/(Ni+Fe+Co)<2.90 \quad (2')$$

Further, the atomic ratio (Fe+Co)/Ni of the total amount of Fe and Co to the amount of Ni satisfies the following Expression (3').

$$0.002\leq(Fe+Co)/Ni<1.500 \quad (3')$$

Herein, a reason for defining the component composition as described above will be described below.

(Zn: More than 2.0 Mass % to 36.5 Mass %)

Zn is a basic alloy element in the copper alloy at which the embodiment is aimed and Zn is an element effective in improvement of strength and spring properties. In addition, since Zn is more inexpensive than Cu, it is also effective in reduction of material cost of the copper alloy. The reduction effect of material cost is not sufficiently exhibited in the case where an amount of Zn is 2.0 mass % or less. On the other hand, in the case where the amount of Zn exceeds 36.5 mass %, corrosion resistance decreases and cold rollability may also be decreased.

Accordingly, the amount of Zn is set to be in a range of more than 2.0 mass % to 36.5 mass %. In the range described above, the amount of Zn is preferably in a range of 5.0 mass % to 33.0 mass % and more preferably in a range of 7.0 mass % to 27.0 mass %.

(Sn: 0.10 Mass % to 0.90 Mass %)

Addition of Sn is effective in improvement of strength and effective in improvement of recycling efficiency of Sn-plated Cu—Zn alloy material. In addition, it is clearly determined by research of the inventors, that coexistence of Sn and Ni also contributes to improvement of stress relaxation resistance. In the case where the amount of Sn is less than 0.10 mass %, these effects are not sufficiently obtained, and on the other hand, in the case where the amount of Sn exceeds 0.90 mass %, hot workability (formability) and cold rollability may be decreased and cracks may be generated in hot rolling or cold rolling, and electrical conductivity may also decrease.

Therefore, the amount of Sn is set to be in a range of 0.10 mass % to 0.90 mass %. In the range described above, the amount of Sn is particularly preferably in a range of 0.20 mass % to 0.80 mass %.

(Ni: 0.15 Mass % to Less than 1.00 Mass %)

It is possible to precipitate a Ni—P based precipitate from a matrix phase (mainly α phase) by adding Ni with P. In addition, by adding Ni with P and either one or both of Fe and Co, it is possible to precipitate a [Ni, (Fe, Co)]—P based precipitate from a matrix phase (mainly α phase). The effect of pinning a grain boundary at the time of recrystallization is obtained by the Ni—P based precipitate or the [Ni, (Fe, Co)]—P based precipitate. Therefore, it is possible to decrease the average grain size and to improve strength, bending formability, and resistance to stress corrosion cracking. In addition, due to the presence of the precipitates, it is possible to greatly improve stress relaxation resistance. Further, by making Ni coexist with Sn, (Fe, Co), and P, it is also possible to improve stress relaxation resistance due to solid solution strengthening. Herein, in the case where the added amount of Ni is less than 0.15 mass %, it is difficult to sufficiently improve stress relaxation resistance. On the other hand, in the case where the added amount of Ni is 1.00 mass % or more, the amount of Ni in solid solution becomes large; and thereby, electrical conductivity decreases, and the cost increases due to an increase in a used amount of expensive Ni raw material.

Therefore, the amount of Ni is set to be in a range of 0.15 mass % to less than 1.00 mass %. In the range described above, the amount of Ni is particularly preferably in a range of 0.20 mass % to less than 0.80 mass %.

(P: 0.005 Mass % to 0.100 Mass %)

P has a strong affinity for Ni. In the case where an appropriate amount of P is contained with Ni, it is possible to precipitate Ni—P based precipitate, and by adding P with either one or both of Fe and Co, it is possible to precipitate a [Ni, (Fe, Co)]—P based precipitate from a matrix phase (mainly α phase). Due to the presence of the Ni—P based precipitate or [Ni, (Fe, Co)]—P based precipitate, it is possible to improve stress relaxation resistance. Herein, in the case where the amount of P is less than 0.005 mass %, it is difficult to sufficiently precipitate the Ni—P based precipitate or the [Ni, (Fe, Co)]—P based precipitate; and thereby, it is difficult to sufficiently improve stress relaxation resistance. On the other hand, in the case where the amount of P exceeds 0.100 mass %, the amount of P in solid solution becomes large; and thereby, electrical conductivity decreases and rollability decreases, and as a result, cracks are easily generated during cold rolling.

Accordingly, the amount of P is set to be in a range of 0.005 mass % to 0.100 mass %. In the range described above, the amount of P is particularly preferably in a range of 0.010 mass % to 0.080 mass %.

Since P is an element which is inevitably mixed from a raw material of the copper alloy, it is preferable that the raw material be suitably selected, in order to control the amount of P as described above.

(Fe: 0.001 Mass % to Less than 0.100 Mass %)

Fe is not necessarily an essential additive element, but it is possible to precipitate a [Ni, Fe]—P based precipitate from a matrix phase (mainly α phase) by adding a small amount of Fe with Ni and P. In addition, it is possible to precipitate a [Ni, Fe, Co]—P based precipitate from a matrix phase (mainly α phase) by further adding a small amount of Co. Due to an effect of pinning a grain boundary at the time of recrystallization by the [Ni, Fe]—P based precipitate or the [Ni, Fe, Co]—P based precipitate, it is possible to decrease the average grain size and to improve strength, bending formability, and resistance to stress corrosion cracking. In addition, due to the presence of the precipitates, it is possible to greatly improve stress relaxation resistance. Herein, in the case where the added amount of Fe is less than 0.001 mass %, the effect of further improving stress relaxation resistance due to the addition of Fe is not obtained. On the other hand, in the case where the added amount of Fe is 0.100 mass % or more, the amount of Fe in solid solution becomes large; and thereby, electrical conductivity decreases and cold rollability may also be decreased.

Therefore, in the embodiment, in a case of adding Fe, the amount of Fe is set to be in a range of 0.001 mass % to less than 0.100 mass %. In the range described above, the amount of Fe is particularly preferably in a range of 0.002 mass % to 0.080 mass %. Even in the case where Fe is not actively added, less than 0.001 mass % of Fe may be contained as impurities.

(Co: 0.001 Mass % to Less than 0.100 Mass %)

Co is not necessarily an essential additive element, but it is possible to precipitate a [Ni, Co]—P based precipitate from a matrix phase (mainly α phase) by adding a small amount of Co with Ni and P. In addition, it is possible to precipitate a [Ni, Fe, Co]—P based precipitate from a matrix phase (mainly α phase) by further adding a small amount of Fe. It is possible to further improve stress relaxation resistance by the [Ni, Fe]—P based precipitate or the [Ni, Fe, Co]—P based precipitate. Herein, in the case where the added amount of Co is less than 0.001 mass %, an effect of further improving stress relaxation resistance due to the addition of Co is not obtained. On the other hand, in the case where the added amount of Co added is 0.100 mass % or more, the amount of Co in solid solution becomes large; and thereby, electrical conductivity decreases and the cost increases due to an increase in a used amount of expensive Co raw material.

Therefore, in the embodiment, in a case of adding Co, the amount of Co is set to be in a range of 0.001 mass % to less than 0.100 mass %. In the range described above, the amount of Co is particularly preferably in a range of 0.002 mass % to 0.080 mass %. Even in the case where Co is not positively added, less than 0.001 mass % of Co may be contained as impurities.

The balance of respective elements described above may be basically Cu and inevitable impurities. Herein, examples of the inevitable impurities include (Fe), (Co), Mg, Al, Mn, Si, Cr, Ag, Ca, Sr, Ba, Sc, Y, Hf, V, Nb, Ta, Mo, W, Re, Ru, Os, Se, Te, Rh, Ir, Pd, Pt, Au, Cd, Ga, In, Li, Ge, As, Sb, Ti, Tl, Pb, Bi, S, O, C, Be, N, H, Hg, B, Zr, rare earth elements, and the like. The total amount of the inevitable impurities is desirably 0.3 mass % or less.

In addition, in the copper alloy for an electronic and electrical equipment of the embodiment, it is important not only to adjust a range of an added amount of each alloy element as described above, but also to control atomic ratios between the amounts of the respective elements so as to satisfy Expressions (1) and (2) or Expressions (1') to (3'). Herein, restricting reasons of Expressions (1) and (2) or Expressions (1') to (3') will be described below.

$$3.00<Ni/P<100.00 \quad \text{Expression (1):}$$

In the case where the ratio Ni/P is 3.00 or less, stress relaxation resistance decreases as the proportion of P in solid solution increases. At the same time, due to P in solid solution, electrical conductivity decreases, rollability decreases; and thereby, cracks are easily generated during cold rolling, and bending formability also decreases. On the other hand, in the case where the ratio Ni/P is 100.00 or more, electrical conductivity decreases due to an increase in a proportion of Ni in solid solution, and the used amount of expensive Ni raw material becomes relatively large; and thereby, the cost increases. Therefore, the ratio Ni/P is controlled to be in the range described above. In the range described above, it is preferable that the upper limit value of the ratio Ni/P be 50.00 or less, more preferably be 40.00 or less, even more preferably be 20.00 or less, even further preferably be less than 15.00, and optimally be 12.00 or less.

$$0.10<Sn/Ni<2.90 \quad \text{Expression (2):}$$

In the case where the ratio Sn/Ni is 0.10 or less, a sufficient effect of improving stress relaxation resistance is not exhibited. On the other hand, in the case where the ratio Sn/Ni is 2.90 or more, the amount of Ni is relatively decreases, and accordingly, the amount of Ni—P based precipitate decreases, and stress relaxation resistance may be decreased. Therefore, the ratio Sn/Ni is controlled to be in the range described above. In the range described above, it is preferable that the lower limit of the ratio Sn/Ni be 0.20 or more, more preferably be 0.25 or more, and optimally be more than 0.30. In addition, in the range described above, it is preferable that the upper limit of the ratio Sn/Ni be 2.50 or less, more preferably be 2.00 or less, and most preferably be 1.50 or less.

$$3.00<(Ni+Fe+Co)/P<100.00 \quad \text{Expression (1'):}$$

In the case where either one or both of Fe and Co are added, a material obtained by substituting a part of Ni with Fe or Co may be considered, and Expression (1') is also based on Expression (1). Herein, in the case where the ratio (Ni+Fe+Co)/P is 3.00 or less, stress relaxation resistance decreases as a proportion of P in solid solution increases. At the same time, due to P in solid solution, electrical conductivity decreases, rollability decreases; and thereby, cracks are easily generated during cold rolling, and bending formability also decreases. On the other hand, in the case where the ratio (Ni+Fe+Co)/P is 100.00 or more, electrical conductivity decreases due to an increase in a proportion of Ni, Fe, and Co in solid solution, and used amounts of expensive raw materials of Co and Ni become relatively large; and thereby, the cost increases. Therefore, the ratio (Ni+Fe+Co)/P is controlled to be in the range described above. In the range described above, it is preferable that the upper limit value of the ratio (Ni+Fe+Co)/P be 50.00 or less, more preferably be 40.00 or less, even more preferably be 20.00 or less, even further preferably be less than 15.00, and optimally be 12.00 or less.

$$0.10<Sn/(Ni+Fe+Co)<2.90 \quad \text{Expression (2'):}$$

Expression (2') which relates to the case where either one or both of Fe and Co are added is also based on the Expression (2). In the case where the ratio Sn/(Ni+Fe+Co) is 0.10 or less, a sufficient effect of improving stress relaxation resistance is not exhibited. On the other hand, in the case where the ratio Sn/(Ni+Fe+Co) is 2.90 or more, the amount of (Ni+Fe+Co) is relatively decreased, and accordingly, the amount of [Ni, (Fe, Co)]—P based precipitate decreases, and stress relaxation resistance may be decreased. Therefore, the ratio Sn/(Ni+Fe+Co) is controlled to be in the range described above. In the range described above, it is preferable that the lower limit of the ratio Sn/(Ni+Fe+Co) be 0.20 or more, more preferably be 0.25 or more, and optimally be more than 0.30. In addition, in the range described above, it is preferable that the upper limit of the ratio Sn/(Ni+Fe+Co) be 2.50 or less, more preferably be 2.00 or less, and even more preferably be 1.50 or less.

$$0.002 \leq (Fe+Co)/Ni < 1.500 \quad \text{Expression (3'):}$$

In the case where either one or both of Fe and Co are added, a ratio between the total of the amounts of Ni, Fe, and Co and the amount of Ni is also important. In the case where the ratio (Fe+Co)/Ni is 1.500 or more, stress relaxation resistance decreases, and the cost increases due to an increase in a used amount of expensive Co raw material. In the case where the ratio (Fe+Co)/Ni is less than 0.002, strength decreases, and a used amount of expensive Ni raw material becomes relatively large; and thereby, the cost increases. Therefore, the ratio (Fe+Co)/Ni is controlled to be in the range described above. In the range described above, it is preferable that the ratio (Fe+Co)/Ni be in a range of 0.002 to 1.200. It is more preferable that the ratio (Fe+Co)/Ni be in a range of 0.002 to 0.700.

In a copper alloy for an electronic and electrical equipment in which not only is the amount of each alloy element adjusted but also the ratios between each element are adjusted so as to satisfy Expressions (1) and (2) or Expressions (1') to (3') as described above, it is considered that the Ni—P based precipitate or the [Ni, (Fe, Co)]—P based precipitate is precipitated and dispersed from a matrix phase (mainly α phase) and stress relaxation resistance is improved by the precipitated and dispersed precipitate.

In addition, in the copper alloy for an electronic and electrical equipment of the embodiment, not only is the component composition adjusted as described above, but also the strength is controlled as described below.

That is, in the copper alloy for an electronic and electrical equipment of the embodiment, the strength ratio $TS_{TD}/TS_{LD}$ which is calculated from the strength $TS_{TD}$ obtained when tensile test is performed in a direction perpendicular to the rolling direction and the strength $TS_{LD}$ obtained when tensile test is performed in a direction parallel to the rolling direction, exceeds 1.09 ($TS_{TD}/TS_{LD}>1.09$).

Herein, a reason for controlling the strength as described above will be described below.

($TS_{TD}/TS_{LD}>1.09$)

In the case where the strength ratio $TS_{TD}/TS_{LD}$ exceeds 1.09, a large number of {220} plane exists on a surface vertical to a normal direction with respect to a rolled surface. By increasing the number of {220} plane, excellent bending formability is obtained when bending is performed so that an axis of bending is in a direction perpendicular to a rolling direction, and the strength $TS_{TD}$ when the tensile test is performed in a direction perpendicular to the rolling direction is increased.

Meanwhile, in the case where the {220} plane is remarkably developed, the alloy becomes a deformed structure and bending formability is deteriorated. Therefore, the strength ratio $TS_{TD}/TS_{LD}$, which is calculated from the strength $TS_{TD}$ obtained when tensile test is performed in a direction perpendicular to the rolling direction and the strength $TS_{LD}$ obtained when tensile test is performed in a direction parallel to the rolling direction, is preferably more than 1.09 to 1.3. The strength ratio $TS_{TD}/TS_{LD}$ is more preferably in a range of 1.1 to 1.3. In addition, the strength ratio $TS_{TD}/TS_{LD}$ is even more preferably in a range of 1.12 to 1.3.

In the copper alloy for an electronic and electrical equipment of the embodiment, the strength $TS_{TD}$ obtained when tensile test is performed in a direction perpendicular to the rolling direction is 500 MPa or more, and in the case where a direction perpendicular to the rolling direction is set as an axis of bending, bending formability represented as a ratio R/t when a radius of a W bending tool is set as R and the thickness of a copper alloy is set as t is preferably 1 or less. By setting the strength $TS_{TD}$ and R/t, it is possible to sufficiently ensure the strength in the TD direction and bending formability in the GW direction.

In addition, in the copper alloy for an electronic and electrical equipment of the embodiment, it is preferable that a grain structure is controlled as described below.

In the grain structure, it is preferable that a special grain boundary length ratio (Lσ/L) is 10% or more.

The measurement regarding an α phase containing Cu, Zn, and Sn is performed on a measurement surface area of 1000 $\mu m^2$ or more at every measurement intervals of 0.1 μm by an EBSD method. Next, measured results are analyzed by data analysis software OIM to obtain a CI value in each measurement point, and a measurement point in which a CI value is 0.1 or less is removed. Analysis is performed except for the measurement point in which a CI value is 0.1 or less, and a boundary having more than 15° of an angle difference between neighboring measuring points is assigned as a grain boundary. The special grain boundary length ratio (Lσ/L) which is a ratio of a sum Lσ of respective grain boundary lengths of Σ3, Σ9, Σ27a, and Σ27b to a total L of all the grain boundary lengths is preferably 10% or more.

In addition, an average grain size (including twin crystal) of the α phase containing Cu, Zn, and Sn is preferably in a range of 0.1 μm to 15 μm.

Herein, a reason for controlling the grain structure as described above will be described below.

(Special Grain Boundary Length Ratio)

The special grain boundary is defined as a coincidence boundary in which a Σ value satisfies a relationship of $3 \leq \Sigma \leq 29$, and the Σ value is crystallographically defined based on CSL theory (Kronberg et al: Trans. Met. Soc. AIME, 185, 501 (1949)), and the coincidence boundary is a grain boundary in which the maximum permissible deviation Dq from coincidence satisfies a relationship of $Dq \leq 15°/\Sigma^{1/2}$ (D. G. Brandon: Acta. Metallurgica. Vol. 14, p. 1479, (1966)). Since the special grain boundary is a boundary having high crystallinity (boundary where a degree of disarrangement of atomic arrangement is small), the special grain boundary is rarely a starting point of breakage at the time of working. Accordingly, in the case where the special grain boundary length ratio (Lσ/L) which is the ratio of a sum Lσ of respective grain boundary lengths of Σ3, Σ9, Σ27a, and Σ27b to a total L of all the grain boundary lengths is increased, it is possible to further improve bending formability while maintaining stress relaxation resistance. The special grain boundary length ratio (Lσ/L) is more preferably 12% or more. The special grain boundary length ratio is even more preferably 15% or more.

The CI value (index of reliability) obtained when the value is analyzed by analysis software OIM of an EBSD apparatus decreases when a crystal pattern of measurement points is not clear, and in the case where the CI value is 0.1 or less, the analysis result is hardly relied on. Accordingly, in the embodiment, a measurement point in which the CI value is 0.1 or less and reliability is low is removed.

(Average Grain Size)

It is known that an average grain size of a material affects stress relaxation resistance to some extent. In general, as the average grain size decreases, stress relaxation resistance is decreased. In a case of the copper alloy for an electronic and electrical equipment of the embodiment, it is possible to ensure excellent stress relaxation resistance by suitably adjusting the component composition and the ratios between the respective alloy elements and suitably adjusting the ratio of the special grain boundary having high crystallinity. Accordingly, it is possible to improve the strength and bending formability by decreasing the average grain size. Therefore, it is preferable that the average grain size be 15 μm or smaller in a state after a finishing heat treatment for recrystallization and precipitation in a manufacturing process. In order to further improve the balance between the strength and bending, the average grain size is preferably in a range of 0.1 μm to 10 μm, more preferably in a range of 0.1 μm to 8 μm, and even more preferably in a range of 0.1 μm to 5 μm.

Next, a preferred example of a manufacturing method of the copper alloy for an electronic and electrical equipment of the embodiment described above will be described with reference to a flowchart shown in FIG. 1.

[Melting and Casting Step: S01]

First, molten copper alloy having the component composition described above is prepared. It is preferable that 4NCu (oxygen-free copper or the like) having purity of 99.99% or more be used as a copper raw material, but a scrap may be used as a raw material. In addition, a furnace in the air atmosphere may be used for melting, but in order to prevent oxidization of additive elements, a furnace in the vacuum, or a furnace of which the atmosphere is set to an inert gas atmosphere or a reducing atmosphere may be used.

Next, the molten copper alloy of which the component composition is adjusted is casted by a suitable casting method, for example, a batch type casting method such as a metal mold casting or the like, a continuous casting method, or a semi-continuous casting method; and thereby, an ingot (for example, a slab-shaped ingot) is obtained.

[Heating Step: S02]

Then, if necessary, homogenization heat treatment is performed in order to eliminate segregation of the ingot and homogenize an ingot structure. The conditions of the heat treatment are not particularly limited, but in general, the heating may be performed at a temperature of 600° C. to 950° C. for 5 minutes to 24 hours. In the case where the heat treatment temperature is lower than 600° C. or the heat treatment time is shorter than 5 minutes, a sufficient homogenizing effect may not be obtained. On the other hand, in the case where the heat treatment temperature exceeds 950° C., a part of the segregated portion may be melted, and in the case where the heat treatment time exceeds 24 hours, this condition only causes an increase in cost. The cooling conditions after the heat treatment may be suitably determined, and in general, water quenching may be performed. After the heat treatment, surface grinding is performed, if necessary.

[Hot Working Step: S03]

Next, hot working may be performed on the ingot, in order to exhibit efficiency of rough processing and homogenize the structure. The conditions of the hot working are not particularly limited, and in general, it is preferable that a starting temperature is set to be in a range of 600° C. to 950° C., a finishing temperature is set to be in a range of 300° C. to 850° C., and a processing rate is set to be in a range of 50% to 99%. The above-described heating step S02 may serve as the heating of the ingot to the hot working starting temperature. The cooling conditions after the hot working may be suitably determined, but in general, water quenching may be performed. After the heat treatment, surface grinding is performed, if necessary. A working method of the hot working is not particularly limited, and in the case where a final shape is a sheet or a strip, the ingot may be rolled to have a sheet thickness of approximately 0.5 mm to 50 mm by applying hot rolling. In the case where a final shape is a wire or a bar, extrusion or groove rolling may be applied, and in the case where a final shape is a bulk shape, forging or pressing may be applied.

[Intermediate Plastic Working Processing Step: S04]

Next, intermediate plastic working process is performed on the ingot which is subjected to the homogenization treatment in the heating step S02 or a hot-rolled material which is subjected to the hot working step S03 such as hot rolling and the like. The heating conditions in the intermediate plastic working processing step S04 are not particularly limited, and the temperature is preferably in a range of −200° C. to +200° C. so as to perform cold working or warm working. A processing rate of the intermediate plastic working process is not particularly limited either, but in general, the processing rate is approximately in a range of 10% to 99%. The processing method is not particularly limited, and in the case where a final shape is a sheet or a strip, the rolling may be performed to have a sheet thickness of approximately 0.05 mm to 25 mm. In the case where a final shape is a wire or a bar, extrusion or groove rolling may be applied, and in the case where a final shape is a bulk shape, forging or pressing may be applied. In order to complete solutionizing, the steps of S02 to S04 may be repeated.

[Intermediate Heat Treatment Step: S05]

After cold or warm intermediate plastic working process step S04, intermediate heat treatment serving as recrystallization treatment and precipitation treatment is performed. This intermediate heat treatment is a step performed to recrystallize the structure and to precipitate and disperse Ni—P based precipitates or [Ni, (Fe, Co)]—P based precipitates. Conditions of a heating temperature and a heating time in which the precipitates are generated may be applied, and in general, the heating temperature may be set to be in a range of 200° C. to 800° C. and the heating time may be set to be in a range of 1 second to 24 hours.

Herein, in the intermediate heat treatment, a batch type heating furnace may be used or a continuous annealing line may be used. In a case of performing the intermediate heat treatment using a batch type heating furnace, the heating is preferably performed at a temperature of 300° C. to 800° C. for 5 minutes to 24 hours. In addition, in a case of performing the intermediate heat treatment using a continuous annealing line, a heating reaching temperature is preferably in a range of 350° C. to 800° C. and it is preferable that the resultant material not be held or be held for approximately 1 sec to 5 minutes at a temperature in the range described above. As described above, the heat treatment conditions in the intermediate heat treatment step S05 vary depending on the specific apparatus for executing the heat treatment.

In addition, the atmosphere of the intermediate heat treatment is preferably a non-oxidizing atmosphere (a nitrogen gas atmosphere, an inert gas atmosphere, or a reducing atmosphere).

The cooling conditions after the intermediate heat treatment are not particularly limited, but in general, the cooling may be performed at a cooling rate of approximately 2000° C./sec to 100° C./hour.

The intermediate plastic working process step S04 and the intermediate heat treatment step S05 may be repeated a plurality of times, if necessary.

[Finishing Plastic Working Process Step: S06]

After the intermediate heat treatment step S05, a finishing plastic working process is performed to have final dimensions and a final shape. The processing method of the finishing plastic working process is not particularly limited, and in the case where a final product shape is a sheet or a strip, rolling (cold rolling) may be performed to have a sheet thickness of approximately 0.05 mm to 1.0 mm. In addition, forging, pressing, or groove rolling may be applied according to a final product shape. The processing rate may be suitably selected according to a final sheet thickness and a final shape, but the processing rate is preferably in a range of 5% to 90%. In the case where the processing rate is less than 5%, an effect of improving proof stress is not sufficiently obtained. On the other hand, in the case where the processing rate exceeds 90%, a recrystallized structure is substantially lost and the material may have a deformed structure, and bending formability when a direction perpendicular to the rolling direction is set as an axis of bending may be decreased. The processing rate is preferably in a range of 5% to 90% and more preferably in a range of 10% to 90%. After the finishing plastic working process, the resultant material may be used as a product as it is, but in general, it is preferable to further perform a finishing heat treatment.

[Finishing Heat Treatment Step: S07]

After the finishing plastic working process, a finishing heat treatment step S07 is performed, if necessary, in order to improve stress relaxation resistance and to conduct hardening due to low temperature annealing, or in order to remove residual strain. It is preferable that the finishing heat treatment be performed at a temperature in a range of 150° C. to 800° C. for 0.1 sec to 24 hours. In the case where the heat treatment temperature is high, the heat treatment may be performed for a short period of time, and in the case where the heat treatment temperature is low, the heat treatment may be performed for a long period of time. In the case where the temperature of the finishing heat treatment is lower than 150° C. or the time of the finishing heat treatment is shorter than 0.1 seconds, an effect of removing strain may not be obtained sufficiently. On the other hand, in the case where the temperature of the finishing heat treatment is higher than 800° C., recrystallization may be performed. In addition, in the case where the time of the finishing heat treatment exceeds 24 hours, the cost may be increased. In a case of not performing the finishing plastic working processing step S06, the finishing heat treatment step S07 may be omitted.

[Shape Correction Rolling Step: S08]

After the finishing heat treatment step, rolling for shape correction is performed to homogenize internal stress, if necessary. The shape correction rolling is desirably performed at a processing rate of less than 5%. In the case where the processing rate is 5% or more, sufficient strain is introduced and an effect of the finishing heat treatment process is lost.

By conducting the above-described steps, it is possible to obtain a Cu—Zn—Sn based alloy material having a final product shape. Particularly, when the rolling is applied as the processing method, it is possible to obtain a Cu—Zn—Sn based alloy thin sheet (strip) having a sheet thickness of approximately 0.05 mm to 1.0 mm. Such a thin sheet may be used in a conductive part for an electronic and electrical equipment as it is. However, in general, Sn plating is performed on either one or both of sheet surfaces so as to have a film thickness of approximately 0.1 μm to 10 μm; and thereby, a Sn-plated copper alloy strip is obtained and is generally used in a conductive part for an electronic and electrical equipment such as a connector or other terminals. A method of Sn plating in this case is not particularly limited, and electroplating may be used according to a conventional method or reflow treatment may be performed after electroplating in some cases.

In the copper alloy for an electronic and electrical equipment of the embodiment configured as described above, since the strength ratio $TS_{TD}/TS_{LD}$ exceeds 1.09, a large number of {220} plane exists on a surface vertical to a normal direction with respect to a rolled surface. Accordingly, excellent bending formability is obtained when performing bending so that an axis of bending is in a direction perpendicular to a rolling direction, and the strength $TS_{TD}$ when the tensile test is performed in a direction perpendicular to the rolling direction is increased.

In addition, since the Ni—P based precipitate or the [Ni, (Fe, Co)]—P based precipitate is suitably present from a matrix phase mainly containing an α phase, stress relaxation resistance is reliably and sufficiently excellent and strength (proof stress) is high.

Since a copper alloy thin sheet for an electronic and electrical equipment of the embodiment includes a rolled material of the copper alloy for an electronic and electrical equipment described above, the copper alloy thin sheet for an electronic and electrical equipment has excellent stress relaxation resistance and can be suitably used in a connector or other terminals, a movable conductive piece of an electromagnetic relay, a lead frame, or the like.

In addition, in the case where Sn plating is performed on the surfaces, a component such as a used connector is collected as a scrap of a Sn-plated Cu—Zn based alloy and excellent recycling efficiency can be ensured.

A conductive part for an electronic and electrical equipment and a terminal of the embodiment are configured with the copper alloy for an electronic and electrical equipment and the copper alloy thin sheet for an electronic and electrical equipment described above. Accordingly, stress relaxation resistance thereof is excellent, residual stress is rarely alleviated over time or in a high temperature environment, and reliability is excellent. In addition, it is possible to thin the thickness of the conductive part for an electronic and electrical equipment and the terminal.

Hereinabove, the embodiments of the invention have been described, but the invention is not limited thereto, and modifications can be suitably performed within a range not departing from technical features of the invention.

Examples

Hereinafter, results of confirmatory experiments performed for confirming the effects of the invention will be described as examples of the invention with comparative examples. The following examples are provided to show the effects of the invention, and configurations, processes, and conditions disclosed in the examples do not limit the technical features of the invention.

First, a raw material consisting of a Cu-40 mass % Zn base alloy and oxygen-free copper (ASTM B152 C10100) having purity of 99.99% or more was prepared, and this raw material was charged in a high-purity graphite crucible and melted in a $N_2$ gas atmosphere using an electric furnace. Various additive elements were added into a molten copper alloy to prepare molten alloys having component compositions shown in Tables 1 to 4, and each of the resultant molten alloys was poured in a carbon mold to produce an ingot. Regarding a size of the ingot, the thickness was set to be approximately 30 mm, the width was set to be approximately 50 mm, and the length was set to be approximately 200 mm. Next, each ingot was held at a temperature shown in Tables 5 to 8 for a predetermined amount of time (1 hour to 4 hours) in an Ar gas atmosphere as the homogenization treatment and then water quenching was performed.

Next, hot rolling was performed. The ingot was reheated so that a hot rolling starting temperature became a temperature shown in Tables 5 to 8, and the hot rolling at a rolling rate of approximately 50% was performed in a state where a width direction of the ingot was a rolling direction. Water quenching was performed from the rolling finishing temperature of 300° C. to 700° C., and then, cutting and surface grinding were performed to produce a hot rolled material having a thickness of approximately 14 mm, a width of approximately 180 mm, and a length of approximately 100 mm.

After that, the intermediate plastic working process and the intermediate heat treatment were each performed once or repeated two times.

Specifically, in the case where the intermediate plastic working process and the intermediate heat treatment were each performed once, the cold rolling (intermediate plastic working process) was performed at a rolling rate of approximately 50% or more. Then, as the intermediate heat treatment for recrystallization and precipitation treatment, the resultant material was held at a temperature of 200° C. to 800° C. for a predetermined amount of time (1 second to 1 hour) and then water quenching was performed. After that, the rolled material was cut and surface grinding was performed to remove an oxide film, and the rolled material was subjected to the finishing plastic working process which will be described later.

Meanwhile, in the case where the intermediate plastic working process and the intermediate heat treatment were each repeated two times, first cold rolling (first intermediate plastic working process) was performed at a rolling rate of approximately 50% or more. Then, as the first intermediate heat treatment, the resultant material was held at a temperature of 200° C. to 800° C. for a predetermined amount of time (1 second to 1 hour) and then water quenching was performed. After that, second cold rolling (second intermediate plastic working process) was performed at a rolling rate of approximately 50% or more. Then, as the second intermediate heat treatment, the resultant material was held at a temperature of 200° C. to 800° C. for predetermined amount of time (1 second to 1 hour) and then water quenching was performed. After that, the rolled material was cut and surface grinding was performed to remove an oxide film, and the rolled material was subjected to the finishing plastic working process which will be described later.

After that, as the finishing plastic working process, the cold rolling was performed at a rolling rate shown in Tables 5 to 8.

Then, as the finishing heat treatment, the resultant material was held at a temperature shown in Tables 5 to 8 for a predetermined amount of time (1 second to 4 hours) and then water quenching was performed. Cutting and surface grinding were performed, and rolling was performed at a rolling rate 5% or less for shape correction. Then, a strip for characteristics evaluation having a thickness of 0.2 mm and a width of approximately 180 mm was produced.

Regarding the strip for characteristics evaluation, the average grain size, electrical conductivity, mechanical properties (strength), a special grain boundary length ratio, bending formability, and stress relaxation resistance were evaluated. Regarding each evaluation item, a test method and a measurement method are as follows. The evaluation results thereof are shown in Tables 9 to 12.

[Grain Size Observation]

By setting a surface perpendicular to the width direction of the rolling, that is, a TD surface (Transverse direction) to be an observation surface, a grain boundary and a distribution of differences in crystal orientation were measured as follows by an EBSD measurement apparatus and OIM analysis software.

Polishing was performed using waterproof abrasive paper and diamond abrasive grains. Then, finishing polishing was performed using a colloidal silica solution. Analysis of orientation difference of each crystal grain was performed on a measurement surface area of 1000 $\mu m^2$ or more with an accelerating voltage of an electron beam of 20 kV at every measurement intervals of 0.1 μm, by an EBSD measurement apparatus (Quanta FEG 450 manufactured by FEI Company, OIM Data Collection manufactured by EDAX/TSL (currently AMETEK, Inc.)), and analysis software (OIM Data Analysis ver. 5.3 manufactured by EDAX/TSL (currently AMETEK, Inc.)). The CI value of each measurement point was calculated by the analysis software OIM, and data of which the CI value was 0.1 or less were removed in analysis of the average grain size. Regarding the grain size, as a result of two-dimensional cross section observation, a boundary between measurement points in which an orientation difference between neighboring two crystals was 15° or more was assigned as a grain boundary; and thereby, a grain boundary map was created. Based on a cutting method of JIS H 0501, five lines having predetermined lengths were drawn in each of vertical and horizontal directions on the grain boundary map, a number of crystal grains which were completely cut were counted, and the average value of the cut length was set as the average grain size.

[Electrical Conductivity]

A test piece having a width of 10 mm and a length of 60 mm was taken from the strip for characteristics evaluation and electrical resistance was measured by a four-terminal method. The dimensions of the test piece were measured using a micrometer and the volume of the test piece was calculated. The electrical conductivity was calculated from the measured electrical resistance value and the volume. The test piece was taken so that a longitudinal direction thereof was parallel to the rolling direction of the strip for characteristics evaluation.

[Mechanical Properties]

A 13B test piece regulated in JIS Z 2201 was taken from the strip for characteristics evaluation, and a Young's modulus $E_{TD}$ and a tensile strength $TS_{TD}$ when tensile test was performed in a direction perpendicular to the rolling direction and a Young's modulus $E_{LD}$ and a tensile strength $TS_{LD}$ when tensile test was performed in a direction parallel to the rolling direction were measured, based on JIS Z 2241. The $TS_{TD}/TS_{LD}$ was calculated from the obtained values.

[Special Grain Boundary Length Ratio]

By setting a surface perpendicular to the width direction of the rolling, that is, a TD surface (Transverse direction) to be an observation surface, a grain boundary and a distribution of differences in crystal orientation were measured as follows by an EBSD measurement apparatus and OIM analysis software. Polishing was performed using waterproof abrasive paper and diamond abrasive grains. Then, finishing polishing was performed using a colloidal silica solution. Analysis of orientation difference of each crystal grains was performed on a measurement surface area of 1000 $\mu m^2$ or more with an accelerating voltage of an electron beam of 20 kV at measurement intervals of 0.1 μm, excluding the measurement points where the CI value was 0.1 or less, by an EBSD measurement apparatus (Quanta FEG 450 manufactured by FEI Company, OIM Data Collection manufactured by EDAX/TSL (currently AMETEK, Inc.)) and analysis software (OIM Data Analysis ver. 5.3 manufactured by EDAX/TSL (currently AMETEK, Inc.)), and a boundary having 15° or more of an angle difference between neighboring measuring points was assigned as a grain boundary.

A total grain boundary length L of the grain boundaries in the measurement range was measured, a position of the grain boundary where a boundary surface of neighboring crystal grains configures a special grain boundary is determined, and, the grain boundary length ratio Lσ/L of the sum Lσ of lengths of respective grains of Σ3, Σ9, Σ27a, and Σ27b among the special grains to the total grain boundary length L of the measured grain boundaries was calculated, and the special grain boundary length ratio (Lσ/L) was obtained.

[Bending Formability]

Bending was performed based on Japan Copper and Brass Association technology standard JCBA-T 307:2007 4 test method. A plurality of test pieces having a width of 10 mm and a length of 30 mm were taken from the strip for characteristics evaluation so that an axis of bending was in a direction perpendicular to a rolling direction, and W bending test was performed using a W type jig having a bending angle of 90 degrees and a bending radius of 0.2 mm.

An outer periphery portion of the bended portion was visually observed, and in the case where cracks were observed, it was determined as "x" (bad), and in the case where fractures or minute cracks were not observed, it was determined as "○" (good).

[Stress Relaxation Resistance]

In the stress relaxation resistance test, stress was loaded by a method based on a screw type of cantilever of Japan Copper and Brass Association technology standard JCBA-T 309:2004, and with regard to samples in which an amount of Zn was more than 2 mass % to less than 15 mass % (shown in a column of "2-15 Zn evaluation" in Tables 9 to 12), the residual stress ratio after holding the sample at a temperature of 150° C. for 500 hours was measured. With regard to samples in which an amount of Zn was 15 mass % to 36.5 mass % (shown in a column of "15-36.5 Zn evaluation" in Tables 9 to 12), the residual stress ratio after holding the sample at a temperature of 120° C. for 500 hours was measured.

As a test method, a test piece (width of 10 mm) was taken from each of the strips for characteristics evaluation in a direction perpendicular to the rolling direction, and an initial deflection displacement was set to be 2 mm and a span length was adjusted so that a maximum surface stress of a test piece became 80% of proof stress. The maximum surface stress was determined by the following equation.

$$\text{Maximum surface stress (MPa)}=1.5E_{TD}t\delta_0/L_s^2$$

Herein, $E_{TD}$ represents a Young's modulus (MPa), t represents the thickness of a sample (t=0.5 mm), $\delta_0$ represents initial deflection displacement (2 mm), and $L_s$ represents a span length (mm).

In addition, the residual stress ratio was calculated using the following equation.

$$\text{Residual stress ratio (\%)}=(1-\delta_t/\delta_0)\times 100$$

Herein, $\delta_t$ represents a value obtained by (permanent deflection displacement (mm) after holding a sample at 120° C. for 500 hours or after holding a sample at 150° C. for 500 hours)−(permanent deflection displacement (mm) after holding a sample at room temperature for 24 hours), and $\delta_0$ represents initial deflection displacement (2 mm).

The sample was evaluated as "○" (good) in the case where the residual stress ratio was 70% or more, and the sample was evaluated as "x" (bad) in the case where the residual stress ratio was less than 70%.

Each structure observation result and each evaluation result are shown in Tables 9 to 12.

TABLE 1

[Examples of the invention]

| | Alloy component composition | | | | | | Atomic ratio | | |
|---|---|---|---|---|---|---|---|---|---|
| No. | Zn mass % | Sn mass % | Ni mass % | P mass % | Fe mass % | Co mass % | (Ni + Fe + Co)/P | Sn/(Ni + Fe + Co) | (Fe + Co)/Ni |
| 1 | 35.4 | 0.53 | 0.51 | 0.047 | — | — | 5.73 | 0.51 | 0 |
| 2 | 30.3 | 0.57 | 0.49 | 0.051 | — | — | 5.07 | 0.58 | 0 |
| 3 | 24.1 | 0.66 | 0.56 | 0.062 | — | — | 4.77 | 0.58 | 0 |
| 4 | 25.0 | 0.27 | 0.21 | 0.035 | — | — | 3.17 | 0.64 | 0 |
| 5 | 23.7 | 0.89 | 0.47 | 0.046 | — | — | 5.39 | 0.94 | 0 |
| 6 | 24.6 | 0.59 | 0.90 | 0.051 | — | — | 9.31 | 0.32 | 0 |
| 7 | 25.2 | 0.49 | 0.61 | 0.023 | — | — | 14.00 | 0.40 | 0 |
| 8 | 24.2 | 0.54 | 0.57 | 0.081 | — | — | 3.71 | 0.47 | 0 |
| 9 | 26.6 | 0.60 | 0.53 | 0.061 | — | — | 4.58 | 0.56 | 0 |
| 10 | 19.4 | 0.55 | 0.55 | 0.048 | — | — | 6.05 | 0.49 | 0 |
| 11 | 16.0 | 0.64 | 0.56 | 0.060 | — | — | 4.93 | 0.57 | 0 |
| 12 | 11.4 | 0.65 | 0.70 | 0.043 | — | — | 8.59 | 0.46 | 0 |
| 13 | 10.4 | 0.21 | 0.24 | 0.039 | — | — | 3.25 | 0.43 | 0 |
| 14 | 10.0 | 0.86 | 0.49 | 0.055 | — | — | 4.70 | 0.87 | 0 |
| 15 | 9.8 | 0.62 | 0.91 | 0.057 | — | — | 8.42 | 0.34 | 0 |

TABLE 2

[Examples of the invention]

| No. | Alloy component composition | | | | | | Atomic ratio | | |
|---|---|---|---|---|---|---|---|---|---|
| | Zn mass % | Sn mass % | Ni mass % | P mass % | Fe mass % | Co mass % | (Ni + Fe + Co)/P | Sn/(Ni + Fe + Co) | (Fe + Co)/Ni |
| 16 | 9.1 | 0.51 | 0.63 | 0.050 | — | — | 6.65 | 0.40 | 0 |
| 17 | 8.8 | 0.56 | 0.54 | 0.079 | — | — | 3.61 | 0.51 | 0 |
| 18 | 13.2 | 0.42 | 0.49 | 0.054 | — | — | 4.79 | 0.42 | 0 |
| 19 | 6.9 | 0.63 | 0.54 | 0.038 | — | — | 7.50 | 0.58 | 0 |
| 20 | 4.1 | 0.53 | 0.53 | 0.051 | — | — | 5.48 | 0.49 | 0 |
| 21 | 35.9 | 0.47 | 0.59 | 0.053 | 0.016 | — | 6.04 | 0.38 | 0.028 |
| 22 | 31.7 | 0.51 | 0.63 | 0.051 | 0.020 | — | 6.74 | 0.39 | 0.033 |
| 23 | 27.5 | 0.54 | 0.58 | 0.048 | 0.014 | — | 6.54 | 0.45 | 0.025 |
| 24 | 19.4 | 0.62 | 0.52 | 0.047 | 0.022 | — | 6.10 | 0.56 | 0.044 |
| 25 | 15.5 | 0.51 | 0.56 | 0.053 | 0.024 | — | 5.83 | 0.43 | 0.045 |
| 26 | 8.9 | 0.52 | 0.56 | 0.057 | 0.006 | 0.001 | 5.25 | 0.45 | 0.013 |
| 27 | 6.7 | 0.63 | 0.67 | 0.046 | 0.002 | 0.002 | 7.73 | 0.46 | 0.006 |
| 28 | 3.2 | 0.67 | 0.69 | 0.051 | 0.001 | 0.001 | 7.16 | 0.48 | 0.003 |
| 29 | 2.1 | 0.75 | 0.65 | 0.064 | 0.071 | 0.049 | 6.38 | 0.48 | 0.190 |

TABLE 3

[Examples of the invention]

| No. | Alloy component composition | | | | | | Atomic ratio | | |
|---|---|---|---|---|---|---|---|---|---|
| | Zn mass % | Sn mass % | Ni mass % | P mass % | Fe mass % | Co mass % | (Ni + Fe + Co)/P | Sn/(Ni + Fe + Co) | (Fe + Co)/Ni |
| 30 | 26.1 | 0.63 | 0.88 | 0.005 | — | — | 92.87 | 0.35 | 0 |
| 31 | 23.8 | 0.66 | 0.85 | 0.009 | — | — | 49.84 | 0.38 | 0 |
| 32 | 23.5 | 0.63 | 0.76 | 0.015 | — | — | 26.74 | 0.41 | 0 |
| 33 | 8.5 | 0.67 | 0.98 | 0.006 | — | — | 86.19 | 0.34 | 0 |
| 34 | 9.2 | 0.67 | 0.95 | 0.012 | — | — | 41.78 | 0.35 | 0 |
| 35 | 9.0 | 0.63 | 0.98 | 0.030 | 0.012 | — | 17.46 | 0.31 | 0.013 |
| 36 | 27.1 | 0.17 | 0.65 | 0.044 | — | — | 7.80 | 0.13 | 0 |
| 37 | 25.8 | 0.23 | 0.57 | 0.038 | — | — | 7.92 | 0.20 | 0 |
| 38 | 25.0 | 0.4 | 0.73 | 0.041 | — | — | 9.40 | 0.27 | 0 |
| 39 | 8.1 | 0.16 | 0.55 | 0.035 | — | — | 8.29 | 0.14 | 0 |
| 40 | 12.0 | 0.24 | 0.56 | 0.042 | — | — | 7.04 | 0.21 | 0 |
| 41 | 10.5 | 0.35 | 0.67 | 0.039 | — | — | 9.07 | 0.26 | 0 |
| 42 | 10.6 | 0.59 | 0.63 | 0.045 | — | — | 7.39 | 0.46 | 0 |

TABLE 4

[Comparative Examples]

| No. | Alloy component composition | | | | | | Atomic ratio | | |
|---|---|---|---|---|---|---|---|---|---|
| | Zn mass % | Sn mass % | Ni mass % | P mass % | Fe mass % | Co mass % | (Ni + Fe + Co)/P | Sn/(Ni + Fe + Co) | (Fe + Co)/Ni |
| 101 | 2.9 | 0.41 | 0.36 | 0.020 | — | — | 9.50 | 0.56 | 0 |
| 102 | 10.2 | 0.49 | 0.45 | — | — | — | — | 0.54 | 0 |
| 103 | 5.6 | 0.61 | — | — | — | — | — | — | 0 |
| 104 | 14.8 | — | 0.21 | 0.021 | — | — | 5.28 | 0.00 | 0 |
| 105 | 14.3 | 0.63 | — | 0.012 | — | — | 0.00 | — | 0 |
| 106 | 32.1 | 0.88 | 0.33 | 0.033 | — | — | 5.28 | 1.32 | 0 |

TABLE 5

[Examples of the invention]

| | Step | | | |
|---|---|---|---|---|
| | Homogenization process | Hot rolling | Finishing plastic working process | Finishing heat treatment |
| 1 | 650° C. | 650° C. | 46% | 375° C. |
| 2 | 750° C. | 750° C. | 48% | 375° C. |
| 3 | 800° C. | 800° C. | 47% | 375° C. |
| 4 | 800° C. | 800° C. | 52% | 375° C. |
| 5 | 800° C. | 800° C. | 44% | 375° C. |
| 6 | 800° C. | 800° C. | 56% | 350° C. |
| 7 | 800° C. | 785° C. | 62% | 325° C. |
| 8 | 800° C. | 800° C. | 48% | 350° C. |
| 9 | 800° C. | 800° C. | 61% | 275° C. |
| 10 | 800° C. | 800° C. | 52% | 450° C. |
| 11 | 800° C. | 800° C. | 65% | 450° C. |
| 12 | 800° C. | 800° C. | 59% | 450° C. |
| 13 | 800° C. | 800° C. | 58% | 375° C. |
| 14 | 800° C. | 800° C. | 61% | 375° C. |
| 15 | 800° C. | 800° C. | 61% | 400° C. |

TABLE 6

[Examples of the invention]

| | Step | | | |
|---|---|---|---|---|
| No. | Homogenization process | Hot rolling | Finishing plastic working process | Finishing heat treatment |
| 16 | 800° C. | 800° C. | 43% | 425° C. |
| 17 | 800° C. | 800° C. | 59% | 425° C. |
| 18 | 800° C. | 800° C. | 69% | 275° C. |
| 19 | 800° C. | 800° C. | 79% | 275° C. |
| 20 | 800° C. | 800° C. | 84% | 425° C. |
| 21 | 650° C. | 650° C. | 56% | 275° C. |
| 22 | 800° C. | 800° C. | 59% | 300° C. |
| 23 | 800° C. | 800° C. | 61% | 300° C. |
| 24 | 800° C. | 800° C. | 59% | 425° C. |
| 25 | 800° C. | 800° C. | 61% | 425° C. |
| 26 | 800° C. | 800° C. | 63% | 425° C. |
| 27 | 800° C. | 800° C. | 77% | 425° C. |
| 28 | 800° C. | 800° C. | 83% | 425° C. |
| 29 | 800° C. | 800° C. | 82% | 425° C. |

TABLE 7

[Examples of the invention]

| | Step | | | |
|---|---|---|---|---|
| No. | Homogenization process | Hot rolling | Finishing plastic working process | Finishing heat treatment |
| 30 | 650° C. | 800° C. | 30% | 400° C. |
| 31 | 750° C. | 800° C. | 30% | 400° C. |
| 32 | 800° C. | 800° C. | 30% | 400° C. |
| 33 | 800° C. | 800° C. | 50% | 425° C. |
| 34 | 800° C. | 800° C. | 50% | 425° C. |
| 35 | 800° C. | 800° C. | 50% | 425° C. |
| 36 | 800° C. | 800° C. | 30% | 400° C. |
| 37 | 800° C. | 800° C. | 30% | 400° C. |
| 38 | 800° C. | 800° C. | 30% | 400° C. |
| 39 | 800° C. | 800° C. | 50% | 425° C. |
| 40 | 800° C. | 800° C. | 50% | 425° C. |
| 41 | 800° C. | 800° C. | 50% | 425° C. |
| 42 | 800° C. | 800° C. | 80% | 475° C. |

TABLE 8

[Comparative Examples]

| | Step | | | |
|---|---|---|---|---|
| No. | Homogenization process | Hot rolling | Finishing plastic working process | Finishing heat treatment |
| 101 | 780° C. | 780° C. | 36% | 350° C. |
| 102 | 800° C. | 800° C. | 51% | 250° C. |
| 103 | 700° C. | 800° C. | 25% | 375° C. |
| 104 | 700° C. | 800° C. | 43% | 250° C. |
| 105 | 700° C. | 800° C. | 15% | 375° C. |
| 106 | 700° C. | 800° C. | 97% | 200° C. |

TABLE 9

[Examples of the invention]

| | Evaluation | | | | | | | | |
|---|---|---|---|---|---|---|---|---|---|
| | Grain size | Electrical conductivity | $TS_{LD}$ | $TS_{TD}$ | | Special grain boundary ratio | R/t | Stress relaxation resistance | |
| No. | (μm) | (% IACS) | (MPa) | (MPa) | $TS_{TD}/TS_{LD}$ | (%) | GW | 2-15Zn | 15-36.5Zn |
| 1 | 2.2 | 22 | 668 | 765 | 1.15 | 22 | ○ | — | ○ |
| 2 | 1.3 | 22 | 671 | 761 | 1.13 | 23 | ○ | — | ○ |
| 3 | 1.9 | 23 | 664 | 740 | 1.11 | 24 | ○ | — | ○ |
| 4 | 2.3 | 28 | 648 | 729 | 1.13 | 27 | ○ | — | ○ |
| 5 | 2.0 | 23 | 655 | 719 | 1.10 | 23 | ○ | — | ○ |
| 6 | 1.8 | 22 | 682 | 782 | 1.15 | 26 | ○ | — | ○ |
| 7 | 2.1 | 24 | 687 | 794 | 1.16 | 20 | ○ | — | ○ |
| 8 | 2.0 | 24 | 679 | 758 | 1.12 | 22 | ○ | — | ○ |
| 9 | 1.5 | 25 | 685 | 811 | 1.18 | 18 | ○ | — | ○ |
| 10 | 2.3 | 25 | 621 | 683 | 1.10 | 20 | ○ | — | ○ |
| 11 | 1.9 | 26 | 601 | 727 | 1.21 | 22 | ○ | — | ○ |
| 12 | 2.2 | 28 | 603 | 677 | 1.12 | 22 | ○ | ○ | — |
| 13 | 1.9 | 36 | 613 | 714 | 1.16 | 22 | ○ | ○ | — |
| 14 | 2.1 | 29 | 608 | 704 | 1.16 | 19 | ○ | ○ | — |
| 15 | 2.3 | 28 | 610 | 712 | 1.17 | 18 | ○ | ○ | — |

TABLE 10

[Examples of the invention]

| | Evaluation | | | | | | | | |
|---|---|---|---|---|---|---|---|---|---|
| | Grain size | Electrical conductivity | $TS_{LD}$ | $TS_{TD}$ | | Special grain boundary ratio | R/t | Stress relaxation resistance | |
| No. | (μm) | (% IACS) | (MPa) | (MPa) | $TS_{TD}/TS_{LD}$ | (%) | GW | 2-15Zn | 15-36.5Zn |
| 16 | 2.0 | 31 | 522 | 570 | 1.09 | 23 | ○ | ○ | — |
| 17 | 1.8 | 32 | 605 | 698 | 1.15 | 23 | ○ | ○ | — |
| 18 | 1.2 | 30 | 642 | 799 | 1.24 | 20 | ○ | ○ | — |
| 19 | 1.1 | 34 | 608 | 679 | 1.12 | 21 | ○ | ○ | — |
| 20 | 2.1 | 40 | 601 | 659 | 1.10 | 12 | ○ | ○ | — |
| 21 | 1.4 | 22 | 697 | 797 | 1.14 | 25 | ○ | — | ○ |
| 22 | 1.3 | 24 | 682 | 788 | 1.16 | 21 | ○ | — | ○ |
| 23 | 2.3 | 25 | 678 | 777 | 1.15 | 18 | ○ | — | ○ |
| 24 | 2.3 | 26 | 675 | 756 | 1.12 | 21 | ○ | — | ○ |
| 25 | 2.0 | 27 | 614 | 673 | 1.10 | 21 | ○ | — | ○ |
| 26 | 1.9 | 34 | 603 | 680 | 1.13 | 22 | ○ | ○ | — |
| 27 | 1.7 | 33 | 610 | 681 | 1.12 | 19 | ○ | ○ | — |
| 28 | 1.5 | 39 | 603 | 661 | 1.10 | 17 | ○ | ○ | — |
| 29 | 1.5 | 42 | 604 | 663 | 1.10 | 12 | ○ | ○ | — |

TABLE 11

[Examples of the invention]

| | Evaluation | | | | | | | | |
|---|---|---|---|---|---|---|---|---|---|
| | Grain size | Electrical conductivity | $TS_{LD}$ | $TS_{TD}$ | | Special grain boundary ratio | R/t | Stress relaxation resistance | |
| No. | (μm) | (% IACS) | (MPa) | (MPa) | $TS_{TD}/TS_{LD}$ | (%) | GW | 2-15Zn | 15-36.5Zn |
| 30 | 4.5 | 20% | 480 | 524 | 1.09 | 36% | ○ | — | ○ |
| 31 | 3.8 | 21% | 482 | 531 | 1.10 | 35% | ○ | — | ○ |
| 32 | 3.5 | 21% | 502 | 550 | 1.10 | 39% | ○ | — | ○ |
| 33 | 4.3 | 28% | 475 | 518 | 1.09 | 35% | ○ | ○ | — |
| 34 | 3.9 | 28% | 481 | 529 | 1.10 | 38% | ○ | ○ | — |
| 35 | 3.5 | 28% | 501 | 554 | 1.11 | 33% | ○ | ○ | — |
| 36 | 5.6 | 20% | 475 | 524 | 1.10 | 36% | ○ | — | ○ |
| 37 | 4.0 | 20% | 489 | 538 | 1.10 | 35% | ○ | — | ○ |
| 38 | 3.8 | 21% | 491 | 551 | 1.12 | 36% | ○ | — | ○ |
| 39 | 5.3 | 37% | 478 | 523 | 1.09 | 29% | ○ | ○ | — |
| 40 | 4.3 | 32% | 486 | 535 | 1.10 | 30% | ○ | ○ | — |
| 41 | 3.9 | 32% | 496 | 549 | 1.11 | 33% | ○ | ○ | — |
| 42 | 11.2 | 29% | 594 | 683 | 1.15 | 21% | ○ | ○ | — |

TABLE 12

[Comparative Examples]

| | Evaluation | | | | | | | | |
|---|---|---|---|---|---|---|---|---|---|
| | Grain size | Electrical conductivity | $TS_{LD}$ | $TS_{TD}$ | | Special grain boundary ratio | R/t | Stress relaxation resistance | |
| No. | (μm) | (% IACS) | (MPa) | (MPa) | $TS_{TD}/TS_{LD}$ | (%) | GW | 2-15Zn | 15-36.5Zn |
| 101 | 2.6 | 22 | 479 | 491 | 1.03 | 41 | ○ | ○ | — |
| 102 | 2.1 | 31 | 565 | 638 | 1.13 | 26 | ○ | x | — |
| 103 | 2.4 | 40 | 456 | 473 | 1.04 | 29 | ○ | x | — |
| 104 | 2.5 | 35 | 543 | 608 | 1.12 | 33 | ○ | x | — |
| 105 | 2.5 | 30 | 459 | 498 | 1.08 | 37 | ○ | x | — |
| 106 | 1.0 | 45 | 804 | 1085 | 1.35 | 8 | x | — | — |

In Comparative Example 101, the strength ratio $TS_{TD}/TS_{LD}$ was in the range of the invention, and the tensile strength $TS_{TD}$ when tensile test was performed in a direction perpendicular to the rolling direction was low.

In Comparative Example 102, P was not contained and therefore the amount of P was not in the range of the invention, and stress relaxation resistance was evaluated as "x".

In Comparative Example 103, Ni and P were not added and therefore, the amounts of Ni and P were not in the ranges of the invention, the strength ratio $TS_{TD}/TS_{LD}$ was less than 1.09, and the strength $TS_{TD}$ when tensile test was performed in a direction perpendicular to the rolling direction was low. In addition, stress relaxation resistance was evaluated as "x".

In Comparative Example 104, Sn was not contained and therefore the amount of Sn was not in the range of the invention, and stress relaxation resistance was evaluated as "x".

In Comparative Example 105, Ni was not added and therefore the amount of Ni was not in the range of the invention, the strength ratio $TS_{TD}/TS_{LD}$ was less than 1.09, the strength $TS_{TD}$ when tensile test was performed in a direction perpendicular to the rolling direction was low, and stress relaxation resistance was evaluated as "x".

In Comparative Example 106, the strength ratio $TS_{TD}/TS_{LD}$ exceeded 1.3 and bending formability was evaluated as "x". Accordingly, the test for stress relaxation resistance was not executed.

In contrast to this, as shown in Tables 9, 10, and 11, it was found that, regarding all of Examples No. 1 to 41 of the invention in which not only was the amount of each alloy element in the range regulated in the invention, but also the ratios between respective alloy components were in the ranges regulated in the invention, and the $TS_{TD}/TS_{LD}$ was set to be equal to or more than a predetermined value, stress relaxation resistance was excellent, proof stress and bending formability were also excellent, and the sample could be sufficiently applied to a connector or other terminals.

INDUSTRIAL APPLICABILITY

The copper alloy for an electronic and electrical equipment of the invention has sufficiently excellent stress relaxation resistance and excellent strength and bending formability. Therefore, the copper alloy for an electronic and electrical equipment of the invention is suitably applied to a connector or other terminals, a movable conductive piece of an electromagnetic relay, a lead frame, or the like.

The invention claimed is:

1. A copper alloy for electronic and electrical equipment, comprising:

more than 2.0 mass % to 36.5 mass % of Zn;

0.10 mass % to 0.90 mass % of Sn;

0.15 mass % to less than 1.00 mass % of Ni;

0.005 mass % to 0.100 mass % of P; and a balance containing Cu and inevitable impurities, wherein an atomic ratio Ni/P of an amount of Ni to an amount of P satisfies a relationship of 3.00<Ni/P<100.00, an atomic ratio Sn/Ni of an amount of Sn to an amount of Ni satisfies a relationship of 0.10<Sn/Ni<2.90, and a strength ratio $TS_{TD}/TS_{LD}$ is 1.10 or more, where strength $TS_{TD}$ is obtained when a tensile test is performed in a direction perpendicular to a rolling direction and strength $TS_{LD}$ is obtained when another tensile test is performed in a direction parallel to the rolling direction.

2. The copper alloy for electronic and electrical equipment according to claim 1, wherein, the strength $TS_{TD}$ is 500 MPa or more, and is 1 or less, the bending formabililty being determined by the method comprising the steps of;

setting the direction perpendicular to the rolling direction as an axis of bending in a W bending test in which a W bending tool is used, visually observing an outer peripheral portion of a bending portion, setting a radius of the W bending tool as R in the case where no fractures or minute cracks are observed, setting a thickness of the copper alloy as t, and calculating a ratio R/t as the bending formability.

3. The copper alloy for electronic and electrical equipment according to claim 1, wherein a special grain boundary length ratio (Lσ/L) measured by the following method is 10% or more;

measurement regarding an α phase containing Cu, Zn, and Sn is performed on a measurement surface area of 1000 $\mu m^2$ or more at every measurement intervals of 0.1 μm by an EBSD method, measured results are analyzed by data analysis software OIM to obtain a CI value in each measurement point, a measurement point in which a CI value is 0.1 or less is removed, a boundary having more than 15° of an angle difference between neighboring measuring points is assigned as a grain boundary, and a ratio of a sum Lσ of respective grain boundary lengths of Σ3, Σ9, Σ27a, and Σ27b to a total L of all the grain boundary lengths is obtained as the special grain boundary length ratio (Lσ/L).

4. A copper alloy thin sheet for electronic and electrical equipment, comprising a rolled material of the copper alloy for electronic and electrical equipment according to claim 1, wherein a thickness is in a range of 0.05 mm to 1.0 mm.

5. The copper alloy thin sheet for electronic and electrical equipment according to claim 4, wherein a surface of the copper alloy thin sheet is plated with Sn.

6. A conductive part for electronic and electrical equipment, comprising the copper alloy thin sheet for electronic and electrical equipment according to claim 4.

7. A terminal comprising the copper alloy thin sheet for electronic and electrical equipment according to claim 4.

8. A conductive part for electronic and electrical equipment, comprising the copper alloy for electronic and electrical equipment according to claim 1.

9. A terminal comprising the copper alloy for electronic and electrical equipment according to claim 1.

10. The copper alloy for electronic and electrical equipment according to claim 1, wherein the strength ratio $TS_{TD}/TS_{LD}$ is 1.12 or more.

11. A copper alloy for electronic and electrical equipment, comprising:

more than 2.0 mass % to 36.5 mass % of Zn;

0.10 mass % to 0.90 mass % of Sn;

0.15 mass % to less than 1.00 mass % of Ni;

0.005 mass % to 0.100 mass % of P;

either one or both of 0.001 mass % to less than 0.100 mass % of Fe and 0.001 mass % to less than 0.100 mass % of Co; and a balance containing Cu and inevitable impurities, wherein an atomic ratio (Ni+Fe+Co)/P of a total amount (Ni+Fe+Co) of Ni, Fe, and Co to an amount of P satisfies a relationship of 3.00<(Ni+Fe+Co)/P<100.00, an atomic ratio Sn/(Ni+Fe+Co) of an amount of Sn to a total amount (Ni+Fe+Co) of Ni, Fe, and Co satisfies a relationship of $0.10<Sn/(Ni+Fe+Co)<2.90$, an atomic ratio (Fe+Co)/Ni of a total amount of Fe and Co to an amount of Ni satisfies a relationship of $0.002\leq(Fe+Co)/Ni<1.500$, and a strength ratio $TS_{TD}/TS_{LD}$ is 1.10 or more, where strength $TS_{TD}$ is obtained when a tensile test is performed in a direction perpendicular to a rolling direction and strength $TS_{LD}$ is obtained when another tensile test is performed in a direction parallel to the rolling direction.

12. The copper alloy for electronic and electrical equipment according to claim 11, wherein an average grain size of crystal grains of an α phase containing Cu, Zn, and Sn is in a range of 0.1 μm to 15 μm, and a precipitate containing at least one element selected from a group consisting of Fe, Co, and Ni, and P is contained.

* * * * *